United States Patent [19]

Reichstadt

[11] 4,197,896

[45] Apr. 15, 1980

[54] WINDOW SHADE CASING

[76] Inventor: Hans U. Reichstadt, Schwarzbachstr. 41, 4020 Mettmann, Fed. Rep. of Germany

[21] Appl. No.: 894,372

[22] Filed: Apr. 7, 1978

[30] Foreign Application Priority Data

Apr. 9, 1977 [DE] Fed. Rep. of Germany ..... 2715909
Apr. 9, 1977 [DE] Fed. Rep. of Germany ..... 2715910

[51] Int. Cl.[2] ..... E06B 3/32; E06B 9/08; E06B 9/17

[52] U.S. Cl. ..... 160/107; 160/26; 160/133

[58] Field of Search ..... 160/26, 107, 133

[56] References Cited

U.S. PATENT DOCUMENTS

| | | | |
|---|---|---|---|
| 1,644,646 | 10/1927 | Greegor | 160/26 |
| 3,158,195 | 11/1964 | Ney | 160/26 |
| 3,454,073 | 7/1969 | Man | 160/107 |
| 3,658,111 | 4/1972 | Herms | 160/26 |

FOREIGN PATENT DOCUMENTS

| | | | |
|---|---|---|---|
| 2605554 | 8/1977 | Fed. Rep. of Germany | 160/107 |
| 2272253 | 12/1975 | France | 160/26 |

*Primary Examiner*—Peter M. Caun
*Attorney, Agent, or Firm*—Martin A. Farber

[57] ABSTRACT

A window shade casing with a cover wall, a side wall, an outer wall and a casing bottom. The cover wall and the side wall are angularly shaped, are formed mutually alike and are engaged on the casing with their edges. The cover wall and the side wall are hooked in one another.

14 Claims, 7 Drawing Figures

WINDOW SHADE CASING

Figure 1:
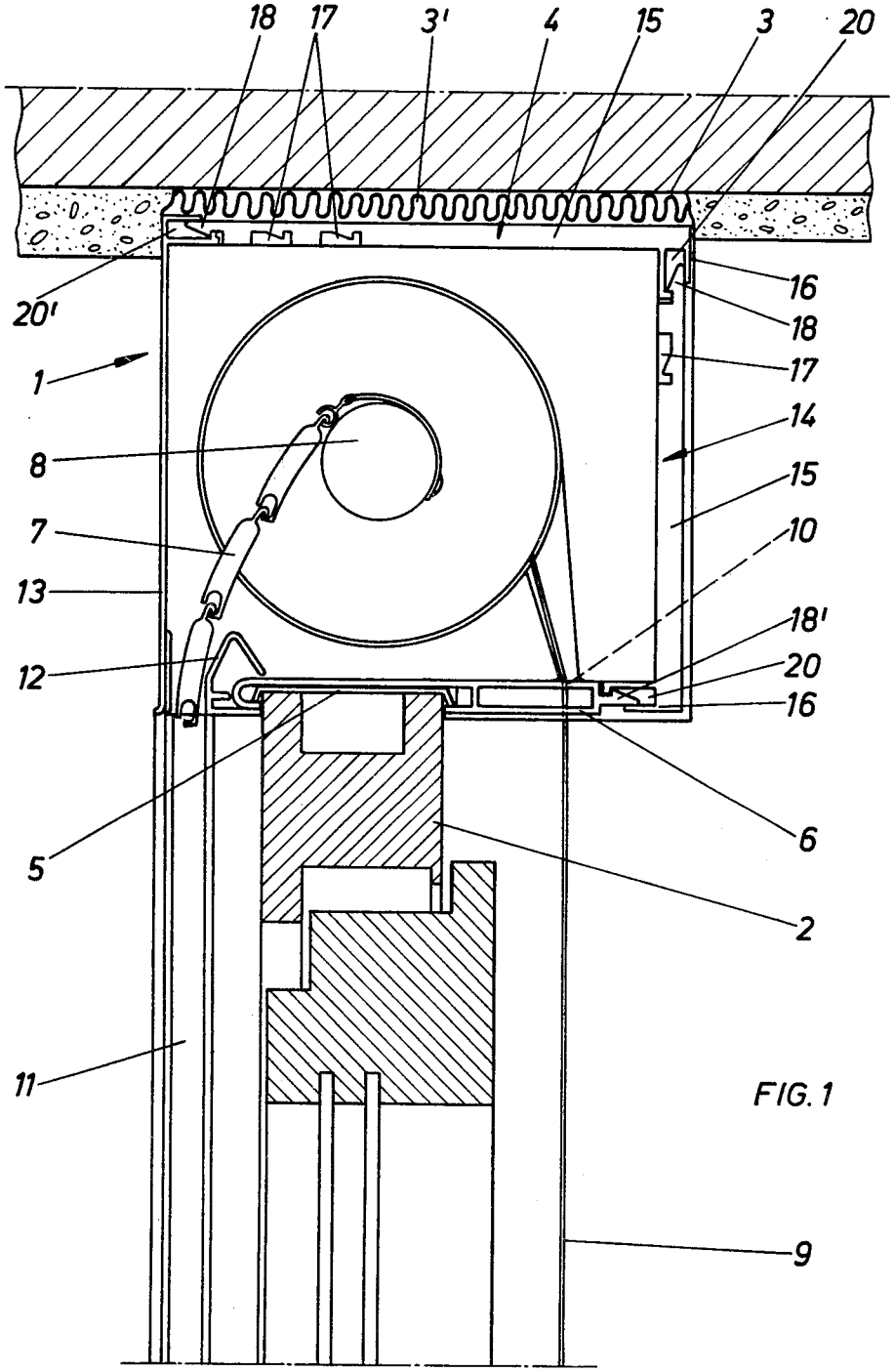

The invention relates to a window shade-casing with cover wall, side wall, outer wall and casing bottom.

It is known with a window shade-casing, to form the outer wall and cover wall integrally materialwise and to provide on the edge of the cover wall which points to the inside space a hinge for the angular shaped side wall (German Gebrauchsmuster Gm No. 7 503 047). The lower shorter angle leg of the side wall constitutes a part of the casing bottom and there is connected with the cover rail by screwing. This formation of the side wall which points to the inner space facilitates the assembly and later repairs. Disadvantageous in this embodiment however is the fact that for differently large sized shade casings, dimensionally other formed construction parts must be used. Consequently for different size window shade casings it is necessary to produce and to store dimensionally different walls, which increases the production expense. After that the lifting-off of th side wall is only possible by means of a tool, namely a screwdriver, with which the screwing between the cover molding which is fastened on the window frame and the shorter leg of the side wall is to be loosened.

The object of the invention is based on the task to form a window shade-casing of the previously set forth type in a simpler manufacturing manner, advantageous in assembling technique, which with the use of construction parts which are alike as possible, the mounting and removal of the side wall which points to the inside space can be performed without tools in spite of a rigid seating or fit.

This task is solved in the manner the angular shaped cover wall and side wall which are formed mutually alike are engaged on the casing with their edges and are hooked in one another.

An advantageous solution in addition then is that each of the longer angle legs on the inner side of the wall has recesses lying one after the other in a row, which recesses in part have profile of the connection catch hooks which stand at the end and form nominal separation locations for shortening the angle leg.

As a result of such formation the production costs of various sized window shade casings can be considerably lowered. Construction, assembly and service are facilitated and reduced in price. The forming or moulding costs for the wall parts and the warehousing are reduced. The cover- and side- walls, which have the same shape with respect to each other, can be adjusted to the dimension of the largest window shade-casing. If e.g., the height of the window shade casing is to be reduced, merely the side wall is cut, i.e., broken-off, to length at the corresponding recess forming a nominal separation point, whereby the catch hook originates. The same is true when the cover wall of the shade casing is to have a smaller dimension. Since construction parts with the same shape can be worked, this also brings advantages with mounting and during shipment, in spite of a larger spread of the dimensions of the window shade casing. The connection of the cover wall and side wall with the outer wall and the casing bottom as well as to one another takes place by means of catch hooks, which considerably simplifies the assembly of the window shade casing. The cover wall and side wall are rigidly hooked or interlocked. The same means, which on the one hand rigidly hooks, on the other hand causes the engagement.

Preferably synthetic or plastic material is suited for the cover wall and side wall, so that these construction parts can be made with a savings in expense in plastic extrusion processes.

An advantageous further formation resides in that the catch hook is triangularly shaped in cross-section and is formed tapering toward the free edge and whereby the outer wall of the associated engagement groove projects less than the opposite groove wall, the latter being equipped on the free end with the shoulder which engages in back of the catch hook. The side wall consequently can be secured on the cover wall by hanging. This hanging connection in the assembled position of the side wall may not be undone by pulling action. In the assembled position the catch hook is supported on the shoulder of the inner groove wall of the shorter angle leg of the cover wall. The shorter angle leg of the side wall, which likewise forms the engagement groove, thereby stands in catch connection with an identically formed catch hook of the casing floor. If now for some purpose, the side wall is to be removed, the engagement between the catch hook of the casing bottom and the engagement groove of the shorter angle leg of the side wall is to be terminated or released. Thereby the side wall swings about the catch hook which is located on the longer angle leg of the side wall, this catch hook here acting as a suspender. As a consequence of the triangularly shaped catch hook which is formed tapering and the shorter projecting wall of the engagement groove, the side wall may be lifted without difficulties. This operation is easy and can be performed in a short time without the insertion of tools.

Moreover it is of advantage that the engagement of the side wall with the casing bottom lies on the other side of the casing bottom which carries the belt passage slot. Thereby the belt is not disturbing during removal of the side wall, which favors assembly and also disassembly.

A further advantageous construction is characterized by a lengthwise-push-in connection between the window shade-casing bottom and the horizontal leg of the upper window frame, in the manner such that the casing bottom has a longitudinal slot corresponding to the width of the horizontal leg of the window frame, which slot continues on both sides in the insert spaces for the projecting sections of the cover rail.

The essential advantage of this embodiment resides in the connection between the casing bottom and the window frame-horizontal leg which can be achieved in a short time, even if the window shade casing is already manufactured finished and mounted and the window shade itself is already disposed therein. With this, merely the casing bottom is to be slipped on the horizontal leg of the window frame, whereby the projecting sections of the cover rail positively enter into the insert spaces of the casing bottom, which spaces extend on both sides of the longitudinal slot. No additional securing of the casing bottom in the transverse direction is to be provided as a consequence of the longitudinal slot which is adjusted to the width of the horizontal leg of the window frame. As has been found, the longitudinal push-in connection is highly loadable, so that any forces which occur can be received without damage.

An advantageous further formation according to the invention resides in that, by means of cutting the freely projecting bottom sections to length, the longitudinal slot is adjustable to the width of the horizontal leg of the upper window frame. The same casing bottom can thus be used for different width window frame profiles, so that advantages arise with production and warehousing.

The window shade casing bottom is guaranteed not to displace in the longitudinal direction in that, by means of a pin, front caps of the window shade casing are positively connected with the guide rails of the shade.

Furthermore it is of advantage that the bottom is formed double-walled and the inner wall covers the cover rail. The outer bottom wall of the casing bottom thus serves exclusively for the production of the longitudinal push-in connection.

It has proven advantageous that the inner wall on the front side, which points to the outlet shaft of the shade mail or flexible plates, transfers into the outer bottom wall via a convexly bent apex. This actuality amounts to an increase in stabilization of the side of the bottom which points to the outlet shaft of the shade mail.

A further advantageous feature resides in that the convexly bent apex, in the vicinity of the shade-rails, is covered by slide-off profiles arranged at the front cap of the shade casing. Consenquently between the front cap of the shade casing and the bottom wall there occurs an overlapping in one another, whereby the stability of the shade casing is increased.

Beyond that a stabilization increase is effected in that the slide-off profile comprises an upwardly directed triangular section and a lower casing section, the latter having an inner support stay in counter superimposition to the convex apex, and aligned thereto forming the insert gap for both of walls of the casing bottom.

The coordination of the front caps of the window shade casing is favored in the manner that the bottom forms screw-in channels for the holding or locking screws of the front caps of the shade casing. The position of overlapping of the casing floor and the front caps in one another thereby in a simple manner may be fixed by means of the locking screws which are equipped with a self-tapping thread. In order to increase the loadability of the window shade mail shaft-bearing pin of the window shade-front caps, the side surfaces of the front caps of the window shade casing are equipped with outwardly opening cavities for pushing-in stabilizing pins, which cavities are arranged coaxially to the bearing pin for the shade mail shaft.

A stability promoting advantage resides thereby in that the cavities are extended by an outwardly projecting collar which is supported in a star-shaped manner against the front surface.

Figure 2:
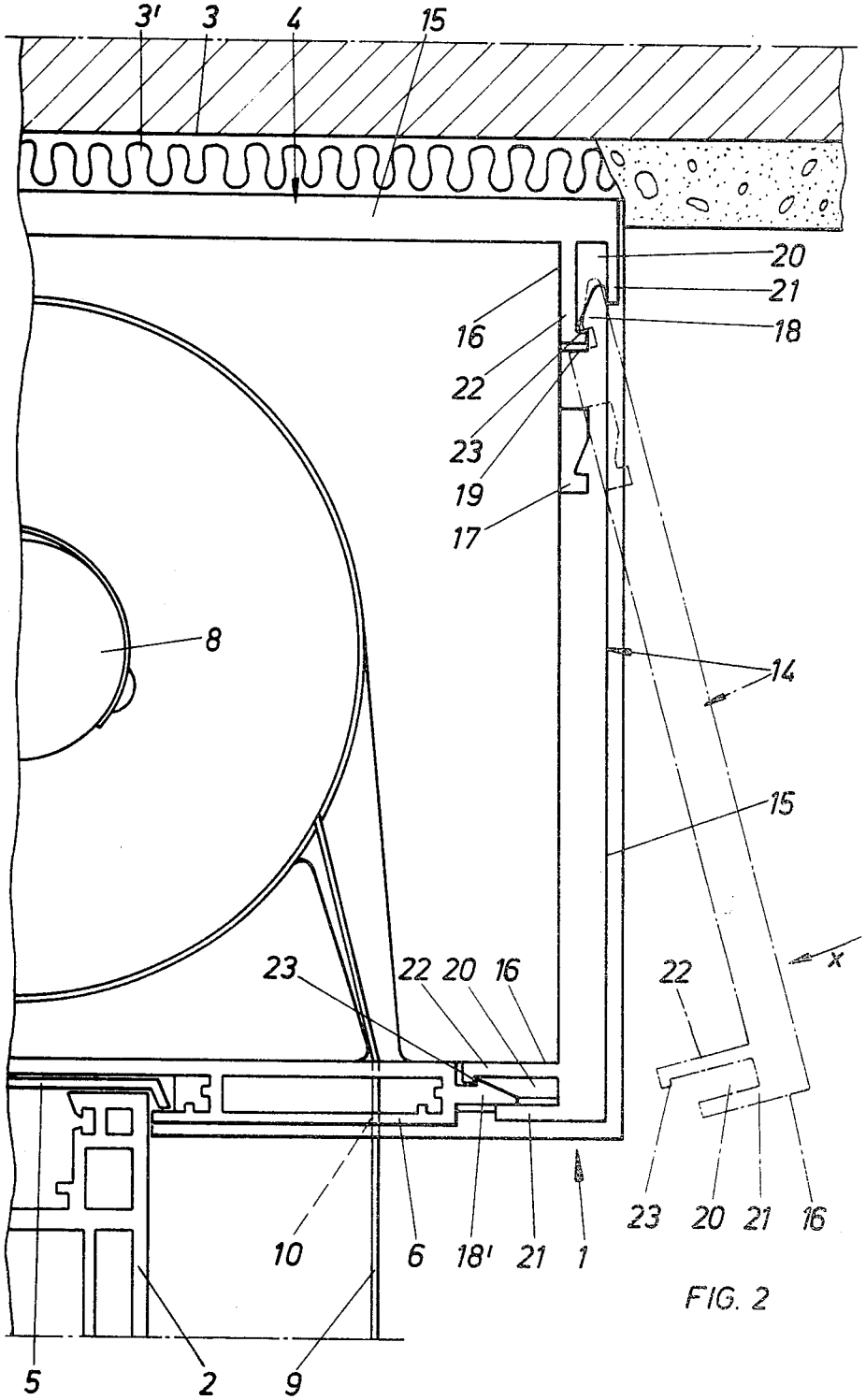
Figure 3:
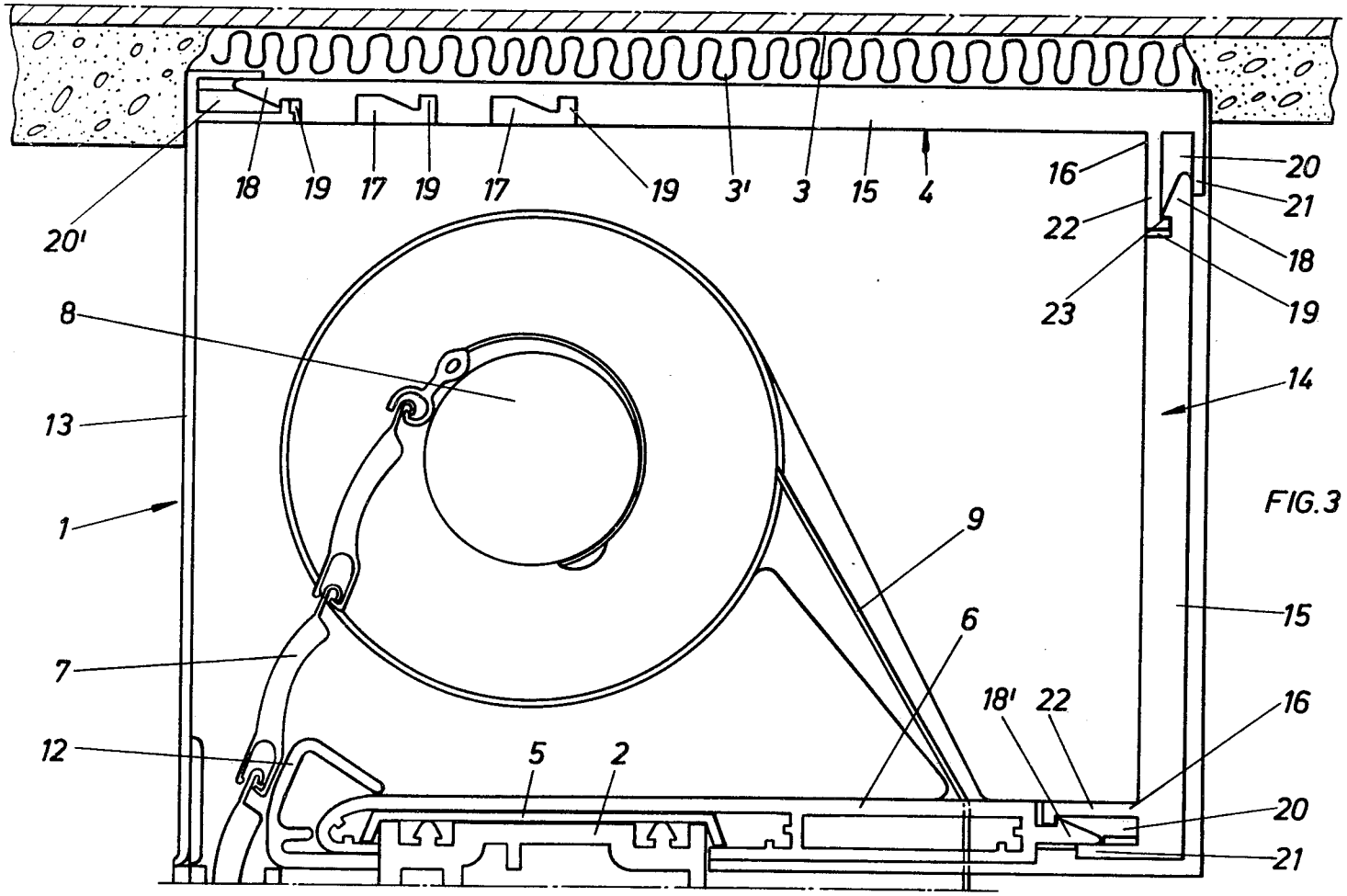
Figure 4:
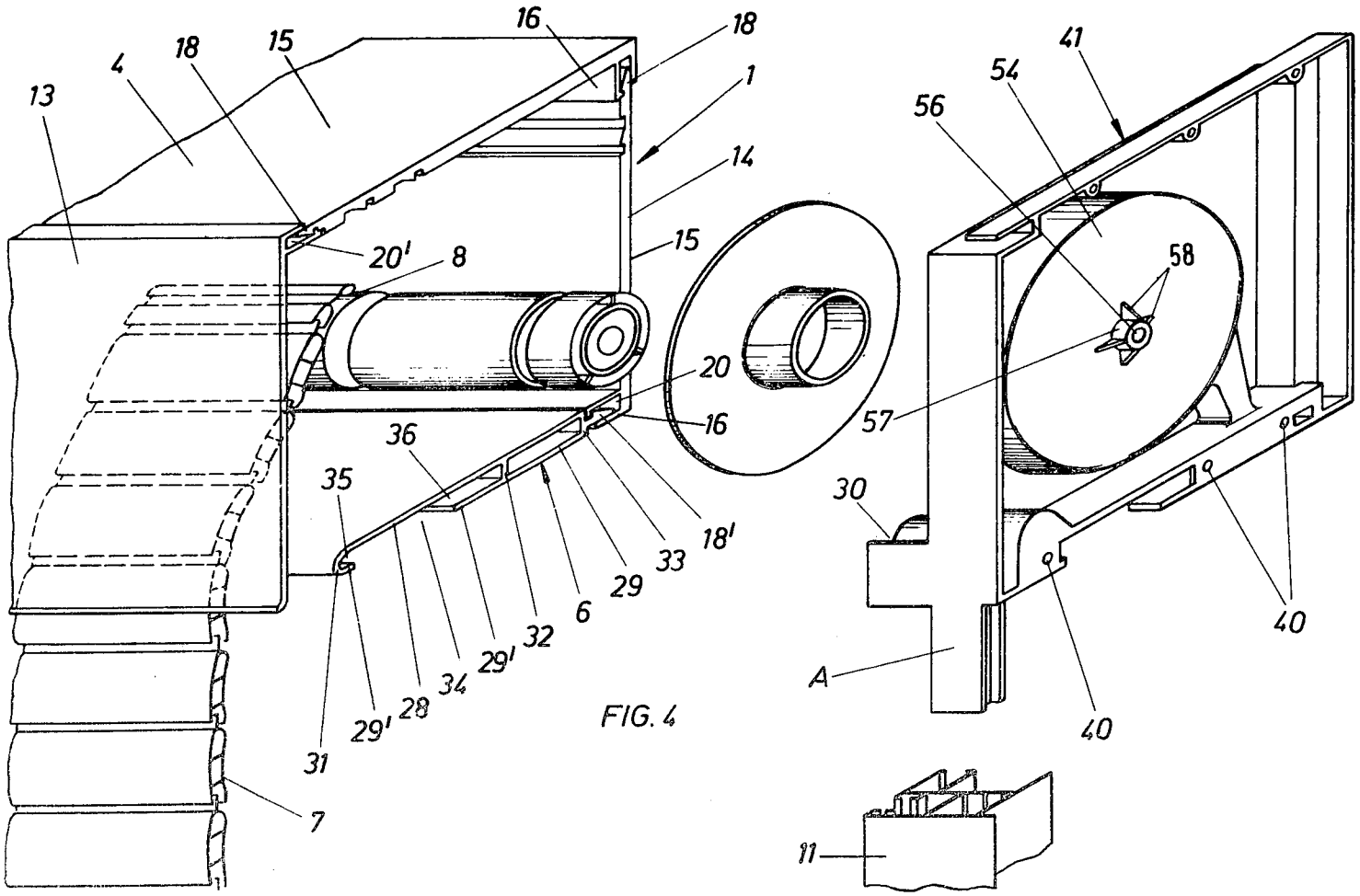
Figure 5:
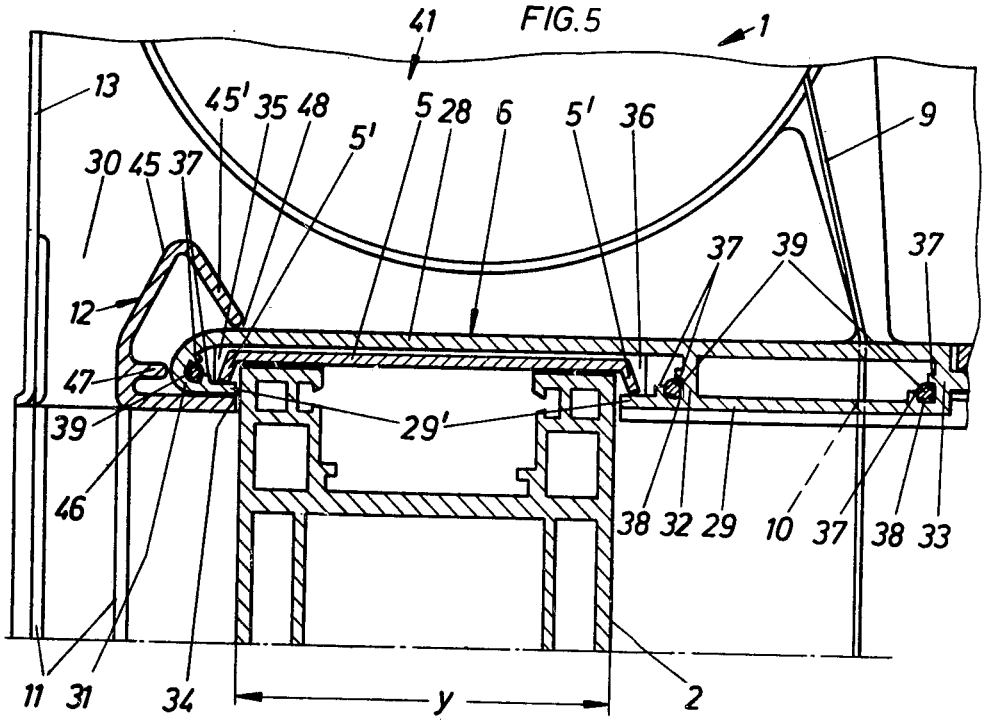
Figure 6:
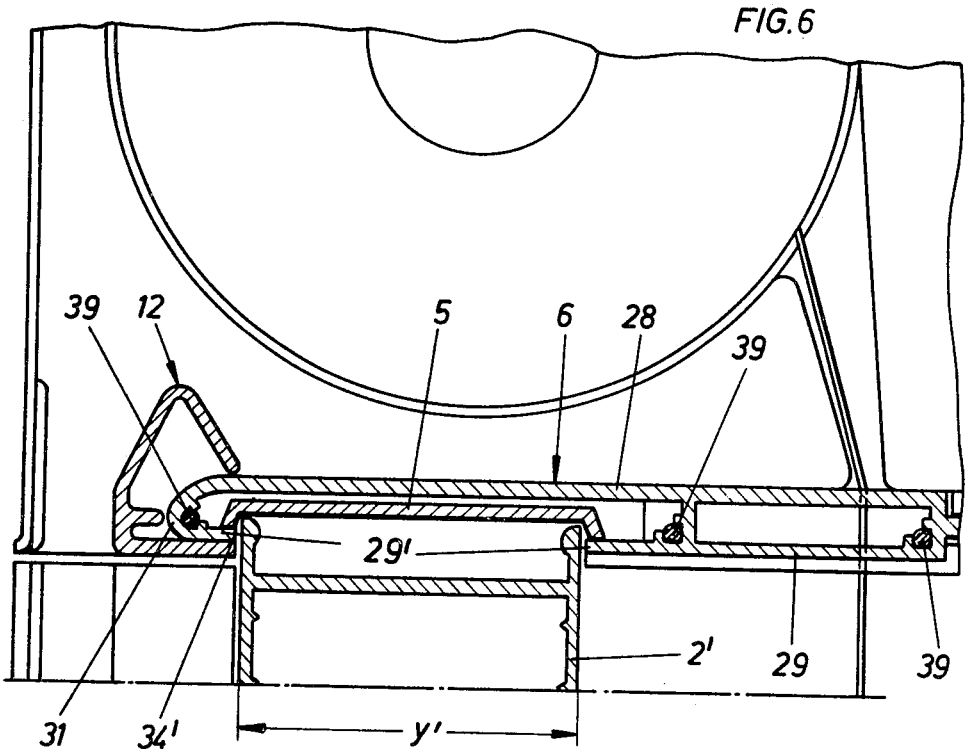
Figure 7:
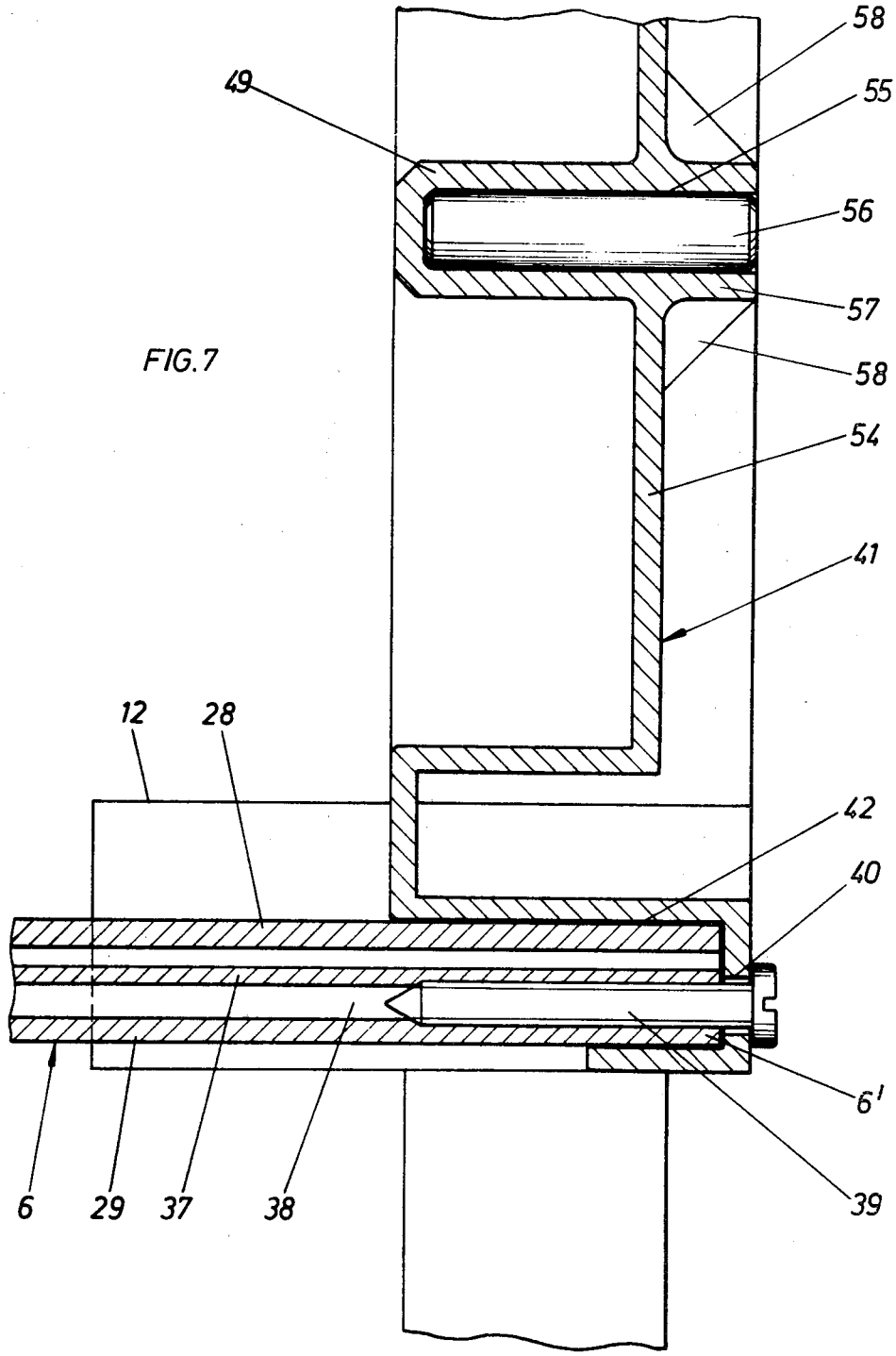

Several embodiment examples are illustrated in the drawings and are more closely described in the following. It shows:

FIG. 1 a vertical section through a shade casing mounted on a window according to the first embodiment, FIG. 2 a broken-away section of FIG. 1 in approximately actual scale, whereby the mounting of the side wall is illustrated in dot-dashed lines, FIG. 3 is a vertical section through a window shade casing of smaller construction height dealing with the second embodiment, FIG. 4 an end section of the window shade casing with an unmounted window shade case-front cap, FIG. 5 is a cross-section through the window shade case in the range of the bottom of the casing in substantially actual scale, FIG. 6 is an illustration relating to a modified embodiment corresponding to FIG. 5, whereby a narrower window frame profile is used, and FIG. 7 is a vertical section through FIGS. 5 and 6, respectively, which section goes through a screw-in channel of the bottom of the case, in enlarged illustration.

The window roller shade casing 1 extends in the space between the horizontal leg 2 of the upper window frame and the window opening 3. Between the cover wall 4 of the window shade casing 1 and the window opening 3 there is provided a layer 3' made of a suitable insulating material.

On its upper side the window frame-horizontal leg 2 carries a cover rail 5 rigidly connected therewith, whose angled-off sections 5' which project on both sides over the horizontal leg are gripped behind the bottom 6 of the casing positively without slipping.

The shaft 8 which receives the mail 7 of the shade extends in the inside of the shade casing. A rotation of the shaft 8 may be undertaken by means of the shade belt 9, which is set through a belt passage slot 10 of the bottom 6 of the casing.

The window shade mail 7 which is windable on the shaft 8 runs in the shade rails 11 which are on the outer side of the window. A slide-off profile 12 which serves as an unwinding aid is coordinated to the upper inlet end. The shade rails 11 terminate approximately flush with the outer wall 13 of the shade casing 1.

Moreover the window shade casing 1 is yet provided with the side wall 14, the latter facing the inside of the space. This side wall and the cover wall 4 are constructed identically. Each cover wall 4 and side wall 14 is composed of the longer angle leg 15 and the shorter angle leg 16. Each of the longer angle legs 15 has a plurality of recesses 17 (cf. FIG. 3) located one after the other in a row adjacent its free end at the inner side of the wall, which recesses have the complementary profile in part of the terminal connection-catch hook 18. These recesses 17 form nominal or desired separating places for shortening (or breaking-off) of the angle leg. According to FIGS. 1 and 2, a shortening has been made on the angle leg 15 of the side wall 14 (and this leg now only shows for example one complete recess 17 remaining).

Each catch hook 18 is formed triangularly in cross section and tapers toward the free edge. The hook 18 arises by means of a narrowed portion of the hook 18 adjacent the widest section thereof forming the undercut notch 19 of the longer angle leg 15.

The shorter angle leg 16 is provided with the engagement groove 20. The outer wall 21 which is shorter than the opposite wall 22, the latter forming a shoulder 23 on the free end. The shoulder 23 of the cover wall 4 is gripped in back by the catch hook 18 of the side wall 14. The catch hook 18' of the shade bottom 6 projects into the engagement groove 20 of the shorter angle leg 16 of the side wall 14, which catch hook 18' corresponds to the shape of the catch hook 18. The catch hook 18' and the engagement groove 20 of the shorter angle leg 16 engage with one another.

Likewise the catch hook 18 of the cover wall 4 stands in catch connection with the engagement groove 20' of the outer wall 13 of the roller casing 1.

In the engaged position (noting FIG. 2) the shoulder 23 extends into the notch 19 which is formed slightly larger than the shoulder. The outer side of the catch hook 18 is aligned straight with the outer side of the angle leg 15 and abuts the outer wall 21 while the inwardly directed point of the widest section of the traiangularly shaped catch hook 18 abuts the inner wall 22 in the engagement groove 20 in the assembled position, the widest section of the catch hook forming a projecting hook edge defining a portion of the notch and engaging on the shoulder 23.

If after mounting of the shade casing, the side wall 14 is to be brought into locking position, the side wall 14, according to the dot-dashed lines in FIG. 2, by means of the catch hook 18, is to be hung on the shoulder 23 of the cover wall 4, and indeed in inclined position. This inclined position is possible as a result of the less far projecting wall of the shorter angle leg 16 of the cover wall 4 and of the catch hook 18, the latter tapering toward the free end. Now the side wall is to be swung in the arrow direction X, whereby the catch connection is brought about between the catch hook 18' and the engagement groove 20 of the shorter angle leg 16 of the side wall 14. Consequently there exists on the one side a hanging-in connection and on the other side a catch connection of the side wall. The hanging-in connection is provided by the catch hook 18, which is supported on the shoulder 23 of the cover wall 4, whereas the snap catching holding is produced by the catch hook 18' of the casing bottom 6, which catch hook 18' steps into the engagement groove 20 of the side wall 14.

The assembly as well as the disassembly of the side wall 14 may be performed without tools.

In FIG. 3 a shade casing of smaller construction height is illustrated. The construction height is reduced naturally with a window of smaller height. The cover wall 4 in the present case can have the same width as with the embodiment according to FIGS. 1 and 2. However the side wall 14 and its longer angle leg 15, respectively, are formed shortened. The catch hook 18 of the side wall 14 was produced by shortening the longer angle leg 15 at the last recess 17 which formed a nominal separation spot. The casing bottom 6 is formed double-walled comprising the inner wall 28 and the wall 29 arranged on the outer side. The inner wall 28 transfers on the front side, which side points to the outlet shaft 30 of the shade mail, into a convexly bent apex 31 in the outer bottom wall 29. Moreover the transversely directed stays 32 and 33, which are integral materialwise, serve for the connection of the walls 28, 29 which are arranged parallel to one another.

The longitudinal slot 34 extends in the outer wall 29 in the vicinity between the convex apex 31 and the stay 32, the width of the slot 34 corresponding approximately to the width y of the horizontal leg 2. The insert spaces 35 and 36 for the reception of the projecting sections 5' of the cover rail 5 arise by the longitudinal slot 34. The height of the insert spaces 35, 36 corresponds approximately to the thickness of the cover rail plus the dimension of the angled sections 5'.

In the area of the convex leg 31 and of the stays 32, 33, there are provided materialwise integrally attached longitudinal ribs 37, which ribs form the screw-in channels 38. The locking screws 39 which are inserted in the latter pass through bores 40 of the front caps 41 of the window shade casing and the screws 39 are equipped with a self-cutting or tapping screw thread. The diameter of the locking screws 39 is chosen somewhat larger than the cross-sectional surface of the screw-in channels 38, which cross-sectional surface stands available for use.

Each front cap 41 of the shade casing is equipped with a plug-in groove 42, in which a front section 6' of the casing bottom 6 is inserted, whereby a stable connection is provided between the casing bottom 6 and the front cap 41 of the shade casing. A pin A originates from the front cap 41 of the shade casing, which pin enters into the shade rail 11 coordinated thereto positively without slipping.

The previously mentioned slide-off profile 12 is located on each front cap 41 of the shade casing in the vicinity of the shade rails 11. The slide-off profile 12 comprises an upwardly directed triangular section 45 and a lower casing section 46. The latter has the support stay 47 in counter superimposition to the convex apex 31 of the casing bottom 6. Aligned thereto, the support stay 47 forms the insert gap 48 for the two walls 28 and 29 of the casing bottom. One of the legs 45' of the upwardly directed triangular section 45 is mounted on the inner wall 28 of the casing bottom 6, whereby a further overlapping in one another of the front cap 41 of the shade casing and the casing bottom 6 is achieved.

The shade shaft-bearing pin 49 of the shade casing-front cap 41 carries the shaft 8 which receives the shade mail or flexible plates 7.

The bearing pin 49 for the shade mail shaft extends integrally materialwise from the side surfaces 54 of the front cap 41. The bearing pin is equipped with an outwardly open coaxial cavity 55, in which there is inserted a stabilizing pin 56 e.g. made of steel. For stabilization, the cavity 55 is extended by an outwardly projecting collar 57, which collar is supported by star-shaped arranged stays 57.

The mail or flexible plates 7 of the shade which is wound off from the shaft 8 runs through the shade mail-outlet shaft 30 and the shade rails 11 connecting thereon. The latter terminate approximately flushly with the outer wall 13 of the shade casing 1.

The previously described construction permits a simplified assembly of the shade casing at the construction site of the window. After slipping on the shade casing, merely only the shade rails 11 are yet to be slid over the pin A and to be fastened on the vertical legs of the window frame. In this manner the shade casing is secured against lateral shifting.

According to FIG. 6 for the horizontal leg 2' of the window frame, a narrower profile having a width y' is selected. Correspondingly, the freely projecting bottom sections 29' which limit the longitudinal slot 34', need to be broken down at a smaller dimension with respect to the embodiment according to FIG. 5. The original longitudinal slot is selected in its width such that it corresponds to the window frame profile of the smallest width.

I claim:

1. A window shade casing for a window, the latter being above a horizontal leg of an upper window frame, comprising a casing including an outer wall, a cover wall, a side wall, and a casing bottom respectively releasably connected to one another, said cover wall and said side wall comprise identical angular shaped members, said side wall and said cover wall have edges engaging on the casing and hooking in one another, each said angular shaped members has a longer angle leg and a shorter angle leg, each of said longer angle legs is formed with a connection catch hook at a free end thereof, each of said longer angle legs is formed with recesses on an inner wall side thereof, said recesses are disposed spaced apart one after the other in the form of a row, said recesses at least in part have the profile of said connection catch hook and form nominal separation positions adapted for shortening of the longer angle leg leaving a catch hook at a free end of the latter, said catch hook has a triangularly shaped cross-section and is formed tapering toward the free edge, said shorter angle leg has an inner groove wall and an outer groove wall spaced therefrom forming an engagement groove therebetween, said outer groove wall is shorter than said inner groove wall, said inner groove wall is formed on a free end thereof with a shoulder, said shoulder engages in back of one of said catch hooks in an assembled position of said walls.

2. The window shade casing according to claim 1, wherein said casing bottom is formed with a belt passage slot on one side portion thereof, said side wall engages said casing bottom on another side portion of said casing bottom.

3. The window shade-casing according to claim 1, further comprising an operative lengthwise-push-in connection between said casing bottom and the horizontal leg of the upper window frame comprising:

said casing bottom being formed with a longitudinal slot corresponding to the width of the horizontal leg of the window frame, said casing bottom being formed such that said slot extends on both sides thereof defining insert spaces, respectively, a cover rail is mounted on said horizontal leg and has projecting sections extending into said insert spaces, respectively.

4. The window shade casing according to claim 3, wherein said casing bottom is formed with free projecting bottom sections defining said insert spaces and engaging said projecting sections of said cover rail, said bottom sections are cuttable, said longitudinal slot is adjustable to the width of the horizontal leg of the upper window frame by cutting said projecting bottom sections of said casing bottom to length.

5. The window shade casing according to claim 1, further comprising front caps of the window shade casing, shade guide rail means for guiding shade mail therein, said front caps are positively connected with the shade guide rail means.

6. The window shade casing according to claim 5, further comprising a cover wall is mounted on the horizontal leg of the upper window frame, said casing bottom is double-walled including an inner wall, the latter covers said cover rail.

7. The window shade casing according to claim 6, wherein means forming an outlet shaft for shade mail to pass therethrough, said casing bottom includes an outer bottom wall, said inner wall has a front side thereof pointing to the outlet shaft, said inner wall on said front side extends into said outer bottom wall forming a convexly bent apex.

8. The window shade casing according to claim 7, further comprising shade guide rail means for guiding shade mail therein, said guide rail means communicates with said outlet shaft, said convexly bent apex is located adjacent to said shade guide rail means, front caps of the shade casing are formed with slide-off profiles, the latter cover said apex.

9. The window shade casing according to claim 8, wherein said slide-off profiles comprise an upwardly directed triangular section and a lower casing section, said lower casing section includes an inner support stay oriented in counter superimposition to said apex and substantially aligned thereto forming an insert gap in said slide-off profiles between said triangular section and said lower casing section, said inner wall and said outer bottom wall of said casing bottom are inserted in said insert gap.

10. The window shade casing according to claim 8, wherein said front cap is formed with a bearing pin means for a shade mail shaft for operatively supporting the latter, said front cap has a side surface formed with an outwardly opening cavity coaxial to and interior to said bearing pin, a stabilizing pin inserted in said cavity.

11. The window shade casing according to claim 10, wherein said front cap has an outwardly projecting collar defining an end portion of said cavity therein, said front cap includes star-shaped support means for supporting said collar against said side surface.

12. The window shade casing according to claim 6, further comprising front caps of the window shade casing, said casing bottom is formed with screw-in channels, locking screw means for locking said front caps of the shade casing, said locking screw means extends through said front caps into said screw-in channels.

13. The window shade casing according to claim 1, wherein said catch hook is formed with a narrowed portion defining a notch adjacent a widest portion of the triangularly shaped cross-section of said catch hook, said widest portion forming a projecting hook edge defining a portion of said notch and engaging on said shoulder in said engagement groove, said shoulder on the free end of said inner groove wall extends in said notch.

14. The window shade casing as set forth in claim 13, wherein said notch is sl'ghtly larger than said shoulder, said catch hook has an outer side aligned with an outer side of said longer angle leg and abuts an adjacent of said angular shaped members against said outer groove wall in said engagement groove while a point of said widest portion abuts said inner groove wall adjacent said shoulder.

* * * * *